United States Patent [19]

Gordon

[11] Patent Number: 4,740,169

[45] Date of Patent: Apr. 26, 1988

[54] ELECTRICAL PLUG PROTECTOR AND CLEANER

[76] Inventor: Steven C. Gordon, 15160 Schipper Ln., Morrison, Ill. 61270

[21] Appl. No.: 15,403

[22] Filed: Feb. 17, 1987

[51] Int. Cl.[4] ..... H01R 13/44

[52] U.S. Cl. ..... 439/148; 439/149; 439/521

[58] Field of Search ..... 339/116 C; 439/38, 116 R, 439/114, 148, 149, 519–522

[56] References Cited

U.S. PATENT DOCUMENTS

| | | | |
|---|---|---|---|
| 2,805,294 | 9/1957 | Edmunds | 339/38 |
| 2,887,861 | 5/1959 | Yessel | 339/114 |
| 4,258,970 | 3/1981 | Bourdon et al. | 339/38 |
| 4,600,261 | 7/1986 | Debbaut | 339/116 C |
| 4,601,528 | 7/1986 | Spier | 439/148 |
| 4,634,207 | 1/1987 | Debbaut | 339/116 |

FOREIGN PATENT DOCUMENTS

| | | | |
|---|---|---|---|
| 790744 | 2/1958 | United Kingdom | 339/114 |

*Primary Examiner*—Gil Weidenfeld
*Assistant Examiner*—Paula A. Austin
*Attorney, Agent, or Firm*—Henderson & Sturm

[57] ABSTRACT

A cover or protector, combined with a cleaner, is provided for use with electrical plugs or terminals when disconnected, thus inhibiting corrosion, etc. of the conductor parts and at the same time employing an abrasive instrumentality that operates to clean the conductor parts as the plug and cover are telescopically connected and disconnected. The cover comprises a base from which projects a portion adapted to telescopically and frictionally mate with a conductor terminal. The cover is formed of non-conductor material and the projecting portion is coated with or otherwise bears an abrasive substance or particles. The cover further includes a peripheral wall for surrounding the plug to further shield it.

1 Claim, 1 Drawing Sheet

ELECTRICAL PLUG PROTECTOR AND CLEANER

BACKGROUND AND SUMMARY OF THE INVENTION

In the field of electrical connections, and especially in the automotive area, connectible and disconnectable plugs are provided, the complementary parts including interfitting conductor terminals. When the plugs are disconnected, as in a vehicle-trailer situation, the terminals are exposed and, when subject to atmospheric exposure, suffer from corrosion, etc., which adversely affects the ability of the terminals to perform efficiently.

The present invention solves the problems associated with this environment by providing a combination cover and cleaning element which not only encloses the terminals but provides an abrasive substance for cleaning the terminals as the cover is installed and removed. A typical plug will include a plurality of conductor terminals, at least one of which is a male and another of which is a female. The inventive cover accomodates both types of terminals by the provision of a cavity or recess for one terminal and a prong for the other. In the recessed element, the interior surface bears an abrasive substance and the prong is coated or otherwise bears a like substance. Thus as the plug and cover are telescopically connected and disconnected, the combination of the abrasive means and frictional fit between the cooperating portions effects a cleaning action on the terminals. Further, the cover has a peripheral or surrounding wall which, when interfitted with the plug, substantially encases the plug and adds to the protection afforded.

The foregoing and other objects and features will become apparent as a preferred embodiment of the invention is set forth below.

DETAILED DESCRIPTION OF A PREFERRED EMBODIMENT OF THE INVENTION

Figure 1:
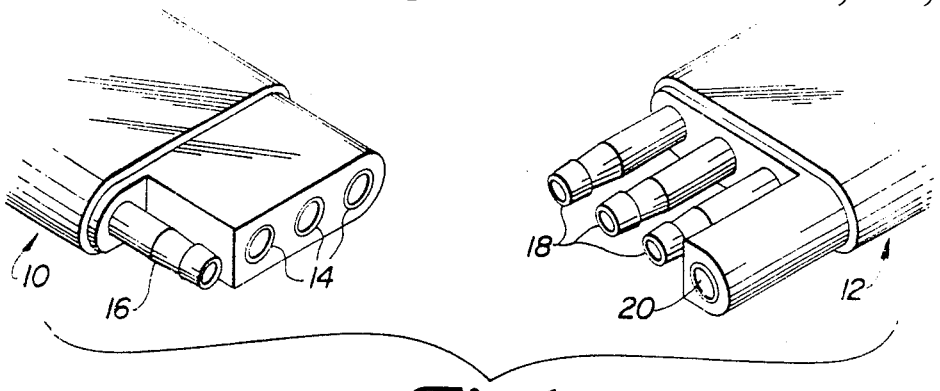
FIG. 1 is an "exploded" perspective of a representative pair of disconnected plugs or couplings.
Figure 3:
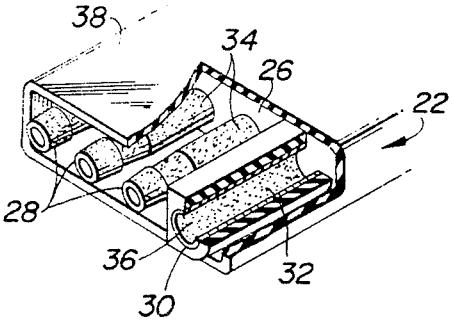
FIG. 3 is a similar view, with portions broken away to expose part of the interior of the cover and cleaner.

FIG. 1 represents a pair of electrical couplers or plugs 10 and 12 in disconnected mode. The plug 10 is typically formed of some well-known non-conductive material and, in this case, has three female conductor terminals 14 and one male terminal 16. As a complementary coupling or plug, the plug 12 has three male terminals 18 and one female terminal 20. Obviously, when the two plugs are interconnected, the male and female terminals telescopically interfit. These plugs are but typical of many plugs for which broader aspects of the invention may be utilized.

Figure 2:
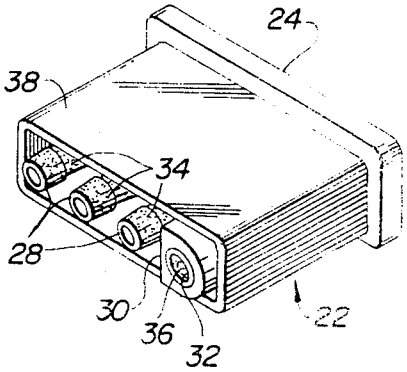
FIG. 2 is a perspective of the combined protector and cleaner per se.

The combination protector and cleaner element is shown by itself in FIG. 2 and is designated at 22. This element is seen as being made fundamentally of dielectric material and has a base 24 formed as part of a body 26 from which project three male portions 28 and one female portion 30. The male portions are here cylindrical and correspond in appearance to the arrangement in the plug 12 of FIG. 1.; i.e., they are adapted to be telescopically frictionally received in three female terminals such as those at 14 in the plug 10. Likewise, the female portion has a cylindrical recess or cavity 32 configured and dimensioned to telescopically interfit with a male terminal such as that at 16 in the plug 10. See FIG. 4. According to the invention, the exterior surfaces of the male portions bear abrasive material, as at 34 and the interior of the female portion is likewise coated or otherwise treated with abrasive material at 36. The manner and type of abrasive application are not significant, since many forms of applications and types may be used, care being taken, of course, that the particles are non-conductive. In use and operation, as the element 22 and plug 10 (or 12) are connected and disconnected, the telescopic and frictional interaction will function to clean the plug terminals and thus keep them free from excessive corrosion.

Figure 4:
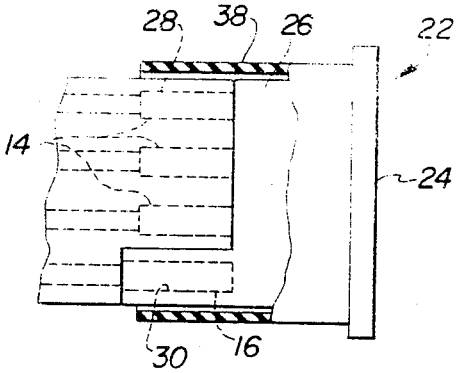
FIG. 4 is a partial sectional view showing how the protector wall encloses the end of the plug.

To further augment the protective character of the element, 22, it has a peripheral or surrounding wall 38 that is affixed to the base 24 and that extends therefrom to the free ends of the portions 28 and 30 and in surrounding relation to those portions. This arrangement gives the element 22 a receptacle effect for receiving the portions of the plug 10 or 12 from which the terminals project and encases these portions as best seen in FIG. 4. The wall is configured to relatively tightly receive one plug or the other.

It will be understood that the elements may be provided in male and female forms, depending upon which plug (10 or 12) is to be accommodated. It may be found that only the plug that remains exposed to the weather after disconnection requires a cover element. Other features and uses will occur to those versed in the art, as will many modifications and alterations in the preferred embodiment disclosed, all without departure from the spirit and scope of the invention.

I claim:

1. For use with an electrical plug of the type having a terminal-bearing part including a free end and provided with a plurality of parallel, axially elongated terminals of cylindrical section exposed at the free end, one of which is a male terminal and the other of which is a female terminal: a protector comprising a body having first and second opposite ends including a base disposed at and closing the first end and a portion integral with the base and extending from the base to the second end and leaving the second end as a free end, the portion including a plurality of parallel terminal-receiving elements exposed at the second end of the body and being spaced apart and equal in number to the plug terminals, one of said elements being a female element and another being a male element and said elements further being cylindrically and axially configured to telescopically and frictionally interfit in moisture-proof fashion respectively with the plug terminals, the protector body further including a continuous peripheral wall integral with the base and projecting to and substantially coterminous with the second end and in spacedly surrounding relation to the male terminal-receiving element, the wall being so configured and dimensioned as to telescopically receive and surround the terminal-bearing part of the plug that provides the female terminal.

* * * * *